US009555992B2

(12) United States Patent
Yamashita et al.

(10) Patent No.: US 9,555,992 B2
(45) Date of Patent: Jan. 31, 2017

(54) SHEET TRANSPORT DEVICE AND IMAGE FORMING APPARATUS

(71) Applicant: FUJI XEROX Co., Ltd., Minato-ku, Tokyo (JP)

(72) Inventors: Tatsuya Yamashita, Kanagawa (JP); Kiyoshi Watanabe, Kanagawa (JP); Toshitaka Tanaka, Kanagawa (JP); Junji Hagihara, Kanagawa (JP); Yuta Chino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/841,910

(22) Filed: Sep. 1, 2015

(65) Prior Publication Data

US 2016/0282783 A1 Sep. 29, 2016

(30) Foreign Application Priority Data

Mar. 27, 2015 (JP) ..... 2015-067615

(51) Int. Cl.
*B65H 9/16* (2006.01)
*B65H 9/00* (2006.01)

(52) U.S. Cl.
CPC ..... *B65H 9/166* (2013.01); *B65H 9/002* (2013.01); *B65H 9/16* (2013.01); *B65H 2301/331* (2013.01)

(58) Field of Classification Search
CPC ..... B65H 9/04; B65H 9/004; B65H 9/002; B65H 2301/331; B65H 9/16; B65H 9/166; B65H 9/163
See application file for complete search history.

(56) References Cited

U.S. PATENT DOCUMENTS 7,404,557 B2 * 7/2008 Tada ..... B65H 7/10 271/226
7,611,142 B2 * 11/2009 Kawashima ..... B65H 9/002 271/228
7,637,499 B2 * 12/2009 Kawashima ..... B41J 13/103 271/238
7,896,339 B2 * 3/2011 Tada ..... B65H 7/10 271/227
7,959,150 B2 * 6/2011 Krucinski ..... B65H 7/08 271/228

(Continued)

FOREIGN PATENT DOCUMENTS

JP 06-191684 A 7/1994
JP 2002-060097 A 2/2002

*Primary Examiner* — Jeremy R Severson
(74) *Attorney, Agent, or Firm* — Sughrue Mion, PLLC

(57) ABSTRACT

A sheet transport device includes a transport path along which a sheet is transported in one direction; a sheet butting portion against which a side edge of the sheet on the transport path is butted, the sheet butting portion being provided at one side of the transport path; a butting section that moves the sheet toward the one side to butt the side edge against the sheet butting portion; and a sheet rotating section located on the upstream side of the butting section in a sheet transport direction, the sheet rotating section having two sheet transport parts provided so as to be shifted from each other in a direction intersecting the one direction, at least one of the sheet transport parts being configured to have a variable sheet transport speed, the sheet rotating section rotating the sheet by utilizing a difference in transport speed between the two sheet transport parts.

3 Claims, 9 Drawing Sheets

(56) References Cited

U.S. PATENT DOCUMENTS

| | | | | |
|---|---|---|---|---|
| 8,746,693 | B2 * | 6/2014 | Miyazawa | B65H 85/00<br>271/227 |
| 2011/0042887 | A1 * | 2/2011 | Kallin | B65H 9/166<br>271/227 |
| 2016/0154360 | A1 * | 6/2016 | Endo | G03G 15/235<br>399/364 |

* cited by examiner

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2015-067615 filed Mar. 27, 2015.

BACKGROUND

Technical Field

The present invention relates to a sheet transport device and an image forming apparatus.

SUMMARY

According to an aspect of the invention, there is provided a sheet transport device including a transport path along which a sheet is transported in one direction; a sheet butting portion against which a side edge of the sheet on the transport path is butted, the sheet butting portion being provided at one side of the transport path; a butting section that moves the sheet on the transport path toward the one side to butt the side edge against the sheet butting portion; and a sheet rotating section located on the upstream side of the butting section in a sheet transport direction, the sheet rotating section having two sheet transport parts provided so as to be shifted from each other in a direction intersecting the one direction, at least one of the sheet transport parts being configured to have a variable sheet transport speed, the sheet rotating section rotating the sheet by utilizing a difference in transport speed between the two sheet transport parts.

BRIEF DESCRIPTION OF THE DRAWINGS

Exemplary embodiment of the present invention will be described in detail based on the following figures, wherein.

DETAILED DESCRIPTION

Referring to the attached drawings, an exemplary embodiment of the present invention will be described in detail below.

Figure 1:
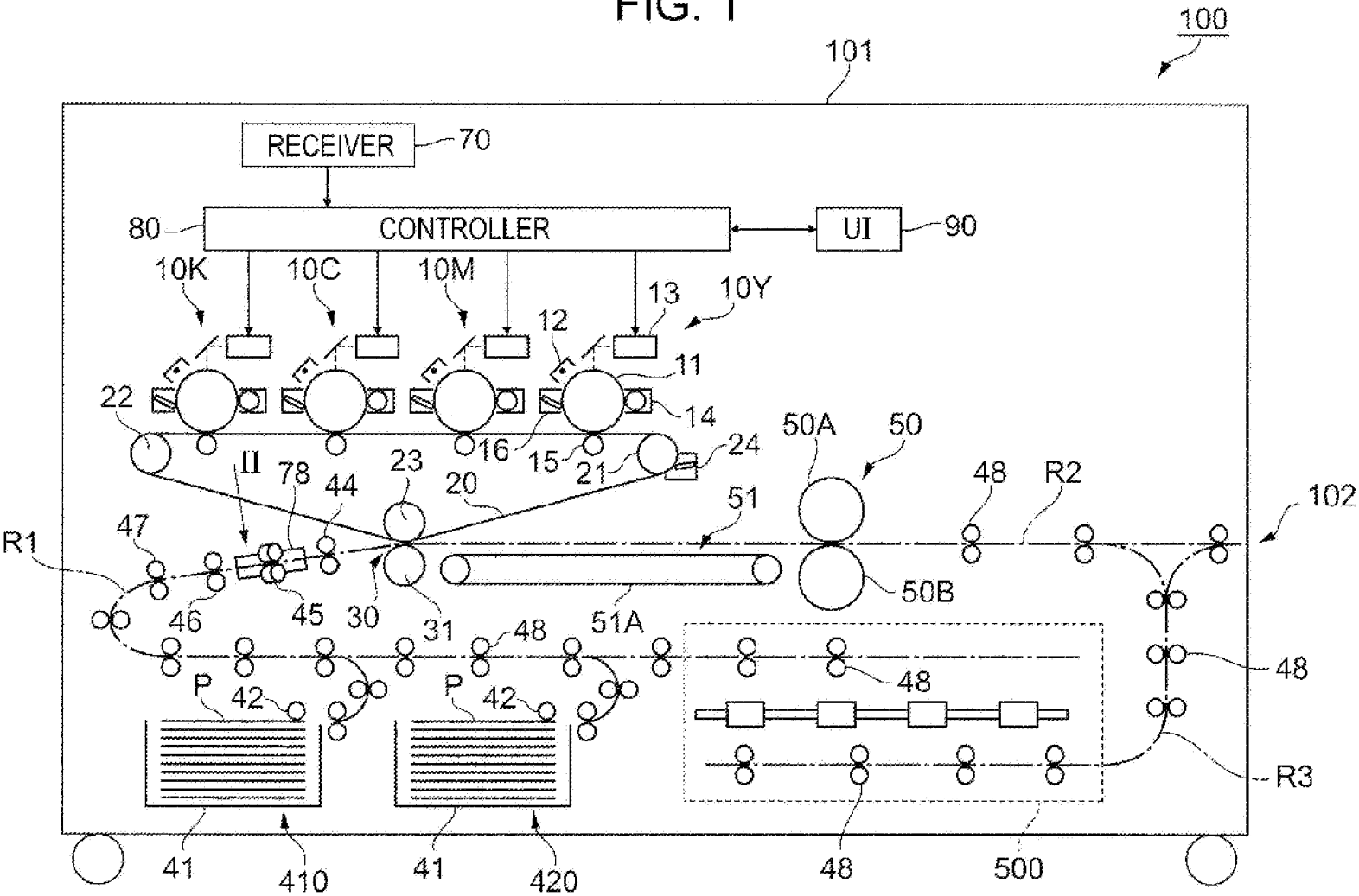
FIG. 1 shows an image forming apparatus, as viewed from the front side.

FIG. 1 shows an image forming apparatus 100 according to this exemplary embodiment, as viewed from the front side.

The image forming apparatus 100 includes image forming units 10 (10Y, 10M, 10C, and 10K) that form color-component toner images by an electrophotographic system.

The image forming apparatus 100 further includes a controller 80 that includes a central processing unit (CPU), a read only memory (ROM), etc. and that controls the operation of the devices and portions of the image forming apparatus 100.

The image forming apparatus 100 further includes a user interface portion (UI) 90. The UI 90 includes a display panel. The UI 90 outputs an instruction received from a user to the controller 80 and displays information from the controller 80 to the user.

The image forming apparatus 100 further includes an intermediate transfer belt 20 to which color-component toner images formed by the image forming units 10 are sequentially transferred (first transfer), and a second transfer device 30 that batch-transfers (second transfer) the toner images on the intermediate transfer belt 20 to a sheet P.

The image forming units 10, the intermediate transfer belt 20, and the second transfer device 30 may be regarded as an image forming section that forms an image on a sheet P.

The image forming apparatus 100 further includes a first sheet-transport path R1, along which a sheet P is transported toward the second transfer device 30; a second sheet-transport path R2, along which the sheet P is transported after passing through the second transfer device 30; and a third sheet-transport path R3 that is branched off the second sheet-transport path R2 and extends below the first sheet-transport path R1.

Furthermore, a reversing mechanism 500 that transports a sheet P from the third sheet-transport path R3 to the first sheet-transport path R1 and reverses the sheet P is provided. A housing 101 of the image forming apparatus 100 has an opening 102.

A sheet P transported along the second sheet-transport path R2 is discharged to the outside of the housing 101 through the opening 102 onto a sheet stacking portion (not shown). A processing device (not shown) may be provided adjacent to the housing 101 for further processing, such as perforating the sheet P discharged from the opening 102.

Furthermore, a first sheet feed device 410 and a second sheet feed device 420 that feed sheets P to the first sheet-transport path R1 are provided.

The first sheet feed device 410 and the second sheet feed device 420 have the same configuration. The first sheet feed device 410 and the second sheet feed device 420 each have a sheet accommodating portion 41 that accommodates sheets P and a pick-up roller 42 that picks up and transports a sheet P accommodated in the sheet accommodating portion 41.

On the upstream side of the second transfer device 30 is a first transport roller (registration roller) 44 that transports a sheet P on the first sheet-transport path R1 toward the second transfer device 30.

The first transport roller 44 temporarily stops a sheet P and then transports the sheet P toward the second transfer device 30 at predetermined timing.

Furthermore, on the upstream side of the first transport roller 44 is a butting portion 78, against which a side edge of a sheet P transported along the first sheet-transport path R1 is butted. The butting portion 78 is provided at one side of the first sheet-transport path R1.

Furthermore, second transport rollers (alignment rollers) 45 are provided in front of the butting portion 78 in the drawings (i.e., in front of the butting portion 78 in the depth direction of the image forming apparatus 100). The second transport rollers 45, serving as an example of a butting section, transport a sheet P downstream, while moving the sheet P toward the butting portion 78 to butt a side edge of the sheet P against the butting portion 78.

On the upstream side of the second transport rollers 45 is a third transport roller (pre-alignment roller) 46 that transports a sheet P downstream, while rotating (turning) the sheet P if necessary.

On the upstream side of the third transport roller 46 is a fourth transport roller 47 that transports a sheet P toward the third transport roller 46.

The portion where the first transport roller 44 to the fourth transport roller 47 are provided has a function of transporting a sheet P, hence, this portion may be regarded as a sheet transport device.

In this exemplary embodiment, in addition to the aforementioned transport rollers, multiple transport rollers 48 are provided along the first sheet-transport path R1, the second sheet-transport path R2, and the third sheet-transport path R3 to transport a sheet P on these sheet-transport paths.

A fixing device 50 is provided on the second sheet-transport path R2. The fixing device 50 fixes an image second-transferred to a sheet P by the second transfer device 30.

Furthermore, between the second transfer device 30 and the fixing device 50 is a transport device 51, which transports a sheet P that has passed through the second transfer device 30 to the fixing device 50. The transport device 51 includes a revolving belt 51A that transports the sheet P thereon.

The fixing device 50 includes a heating roller 50A that is heated by a built-in heater (not shown) and a pressure roller 50B that presses the heating roller 50A.

In the fixing device 50, a sheet P is heated and pressed as it passes between the heating roller 50A and the pressure roller 50B. Thus, an image on the sheet P is fixed.

The image forming units 10 each include a rotatable photoconductor drum 11. The photoconductor drum 11 is surrounded by a charging device 12 that charges the photoconductor drum 11, an exposure device 13 that irradiates the photoconductor drum 11 with light to form an electrostatic latent image thereon, and a developing device 14 that develops the electrostatic latent image on the photoconductor drum 11 with toner.

In addition to the above, there are a first transfer device 15 that transfers the color-component toner image formed on the photoconductor drum 11 to the intermediate transfer belt 20, and a drum cleaning device 16 that removes residual toner on the photoconductor drum 11.

The intermediate transfer belt 20 is stretched around three rollers 21 to 23 so as to be able to revolve. Of these three rollers 21 to 23, the roller 22 drives the intermediate transfer belt 20. The roller 23 is disposed so as to oppose the second transfer roller 31 with the intermediate transfer belt 20 therebetween, and the second transfer roller 31 and the roller 23 form the second transfer device 30. The roller 21 is disposed so as to oppose a belt cleaning device 24 with the intermediate transfer belt 20 therebetween. The belt cleaning device 24 removes residual toner on the intermediate transfer belt 20.

The image forming apparatus 100 according to this exemplary embodiment is capable of forming an image not only on one side of a sheet P fed from the first sheet feed device 410, but also on the other side of the sheet P.

More specifically, in the image forming apparatus 100, a sheet P that has passed through the fixing device 50 is reversed by the reversing mechanism 500, and the reversed sheet P is transported back to the second transfer device 30, where an image is transferred to the other side of the sheet P. Then, the sheet P passes the fixing device 50 again, whereby the transferred image is fixed to the sheet P. In this way, images are formed on both sides of the sheet P.

In the reversing mechanism 500, first, a sheet P on the third sheet-transport path R3 is moved, for example, toward the front side of the image forming apparatus 100, which is a direction perpendicular to the direction in which the third sheet-transport path R3 extends. The sheet P is moved by a transport roller (not shown) provided for this purpose. At this time, the transport rollers 48 on the third sheet-transport path R3 (the transport rollers 48 provided in the reversing mechanism 500) are separated.

The sheet P moved as above is directed upward by being guided by a guide member (not shown) having, for example, a substantially C-shaped section. The sheet P is transported further upward by transport rollers (not shown) for transporting the sheet P upward.

Then, the sheet P moves onto the first sheet-transport path R1 from a side of the first sheet-transport path R1. At this time, the transport rollers 48 on the first sheet-transport path R1 (the transport rollers 48 provided in the reversing mechanism 500) are separated.

Then, the sheet P is nipped by the transport rollers 48, and the transport rollers 48 are rotated. As a result, the reversed sheet P is directed to the second transfer device 30.

Figure 2:
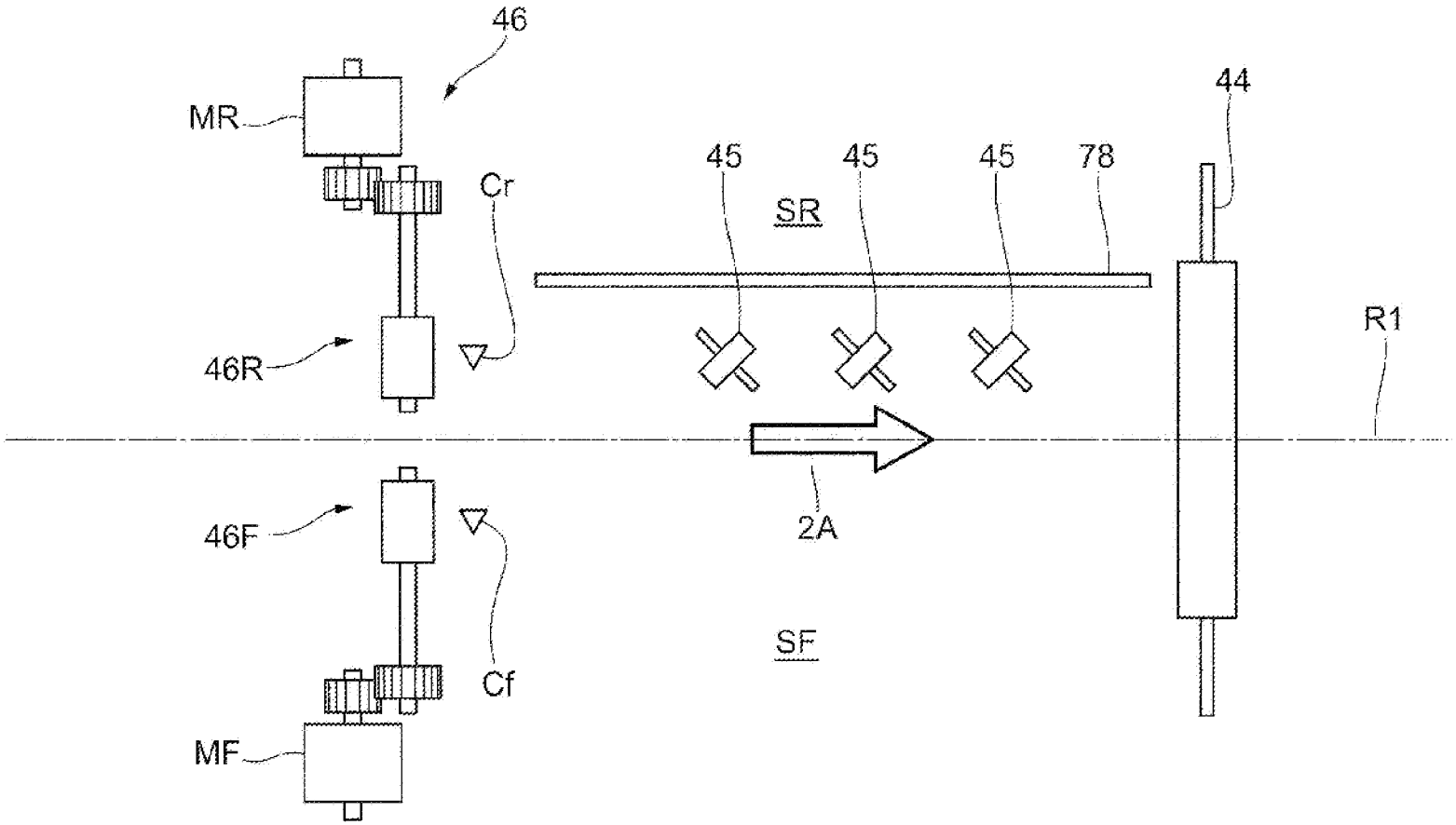
FIG. 2 shows a first sheet-transport path, as viewed from an arrow II direction in FIG. 1.

FIG. 2 shows the first sheet-transport path R1, as viewed from an arrow II direction in FIG. 1.

As shown in FIG. 2, and as has been described above, in this exemplary embodiment, the first transport roller (registration roller) 44 that transports a sheet P on the first sheet-transport path R1 toward the second transfer device 30 (see FIG. 1) is provided.

The butting portion 78, against which a side edge of a sheet P on the first sheet-transport path R1 is butted, is provided at one side SR (i.e., a side on the rear side) of the first sheet-transport path R1.

The butting portion 78 has a plate shape and is provided along the first sheet-transport path R1.

The second transport rollers (alignment rollers) 45 are disposed so as to oppose the butting portion 78. The second transport rollers (alignment rollers) 45 transport a sheet P downstream, while transporting the sheet P toward the butting portion 78 to butt the side edge of the sheet P against the butting portion 78. There are multiple (in this exemplary embodiment, three) second transport rollers 45.

The second transport rollers 45 are provided obliquely. More specifically, rotation shafts of the second transport rollers 45 are arranged at an angle to a direction perpendicular to the direction in which the first sheet-transport path R1 extends.

The third transport roller (pre-alignment roller) 46 includes a front-side roller 46F and a rear-side roller 46R, which are an example of a sheet transport part.

The front-side roller 46F and the rear-side roller 46R are arranged such that they are shifted from each other in a direction perpendicular to (intersecting) the one direction (the direction indicated by an arrow 2A in FIG. 2), along which the sheet P is transported.

Furthermore, in this exemplary embodiment, a front-side motor MF that drives the front-side roller 46F, and a rear-side motor MR that drives the rear-side roller 46R are provided. Hence, in this exemplary embodiment, the front-side roller 46F and the rear-side roller 46R are driven independently.

The front-side roller 46F includes a pair of rotation members (FIG. 2 shows only one of the rotation members). One rotation member is rotated by the front-side motor MF, and the other rotation member is rotated by following the rotation of the one rotation member.

The rear-side roller 46R also includes a pair of rotation members. One rotation member is rotated by the rear-side motor MR, and the other rotation member is rotated by following the rotation of the one rotation member.

Furthermore, in this exemplary embodiment, two sensors, Cr and Cf, for detecting the leading end (leading edge) of a transported sheet P are provided between the third transport roller 46 and the second transport rollers 45. The sensor Cr is provided on the rear side, and the sensor Cf is provided on the front side. Hereinbelow, the sensor Cr will be called a "rear sensor Cr", and the sensor Cf will be called a "front sensor Cf".

Figure 3:
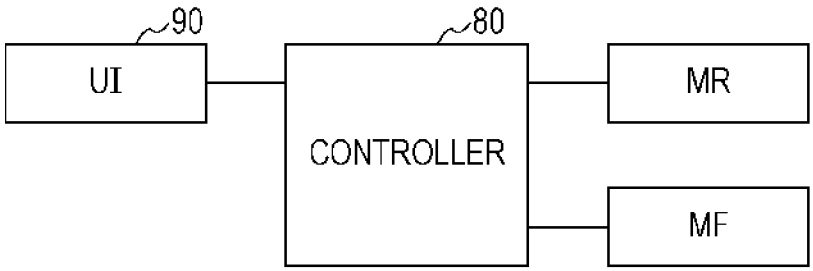
FIG. 3 is a functional block diagram of the image forming apparatus, with regard to control of a third transport roller.

FIG. 3 is a functional block diagram of the image forming apparatus 100, with regard to control of the third transport roller 46 (the front-side roller 46F and the rear-side roller 46R).

As shown in FIG. 3, the front-side motor MF and the rear-side motor MR are connected to the controller 80. In this embodiment, the controller 80 controls the front-side motor MF and the rear-side motor MR. The controller 80 functions as a part of a sheet rotating section. The controller 80 rotates a sheet P by differentiating the number of rotations between the front-side motor MF and the rear-side motor MR (a detailed description will be given below).

The UI 90 is connected to the controller 80. In this embodiment, the UI 90 outputs information about the sheet P to the controller 80. More specifically, in this embodiment, a user enters information about the sheet P via the UI 90. The information includes the basis weight, paper quality, etc., of the sheet P. In this embodiment, the basis weight information and the paper quality information are output from the UI 90 to the controller 80, whereby the controller 80 obtains the basis weight and paper quality of the sheet P.

In this embodiment, the user directly enters the basis weight information and the paper quality information via the UI 90, and the controller 80 obtains the basis weight and the paper quality of the sheet P according to the directly entered information.

It is also possible that, for example, a table representing the relationship between the product name, etc. of the sheet P and the basis weight information and the paper quality information is stored in a memory, and the controller 80 refers to this table to obtain the basis weight and the paper quality of the sheet P.

More specifically, the UI 90 allows a user to enter the information about the sheet P, such as the product name, and the controller 80 obtains the basis weight and the paper quality of the sheet P from the product name, etc. and the information stored in the table.

Figure 4:
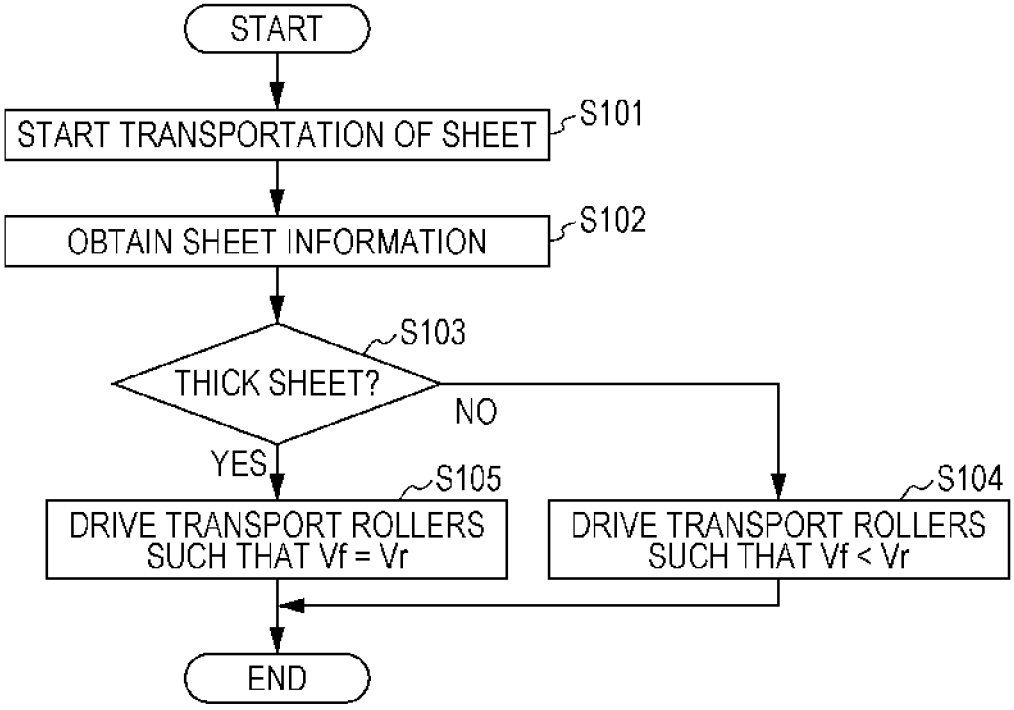
FIG. 4 is a flowchart showing a flow of processing performed by a controller, with regard to control of the third transport roller.

FIG. 4 is a flowchart showing a flow of processing performed by the controller 80, with regard to control of the third transport roller 46.

In this embodiment, first, the controller 80 starts to transport a sheet P (step S101).

More specifically, the first sheet feed device 410 or the second sheet feed device 420 is activated to send a sheet P to the first sheet transport path R1, and the transport rollers 48 are rotated to transport the sheet P to the third transport roller 46.

Next, the controller 80 obtains information about the sheet P, entered by the user via the UI 90 (step S102). In step S102, the controller 80 obtains the basis weight information about the sheet P. Then, the controller 80 determines whether the sheet P that has started to be transported in step S101 is a thick sheet, according to the basis weight information obtained in step S102 (step S103).

In step S103, whether or not the sheet P is a thick sheet is determined by comparing the basis weight obtained in step S102 with a predetermined basis weight (threshold). When the basis weight obtained in step S102 is larger than the predetermined basis weight, the sheet P is determined to be a thick sheet.

When the basis weight obtained in step S102 is smaller than the predetermined basis weight, the sheet P is determined to be a thin sheet.

When the controller 80 determines that the sheet P is not a thick sheet (i.e., the sheet P is a thin sheet) in step S103, it drives the front-side motor MF and the rear-side motor MR such that the rotation speed (the number of rotations) Vr of the rear-side roller 46R is higher (larger) than the rotation speed Vf of the front-side roller 46F (step S104).

When the controller 80 determines that the sheet P is a thick sheet in step S103, it drives the front-side motor MF and the rear-side motor MR such that the rotation speed Vf of the front-side roller 46F and the rotation speed Vr of the rear-side roller 46R are equal (step S105).

Figure 5:
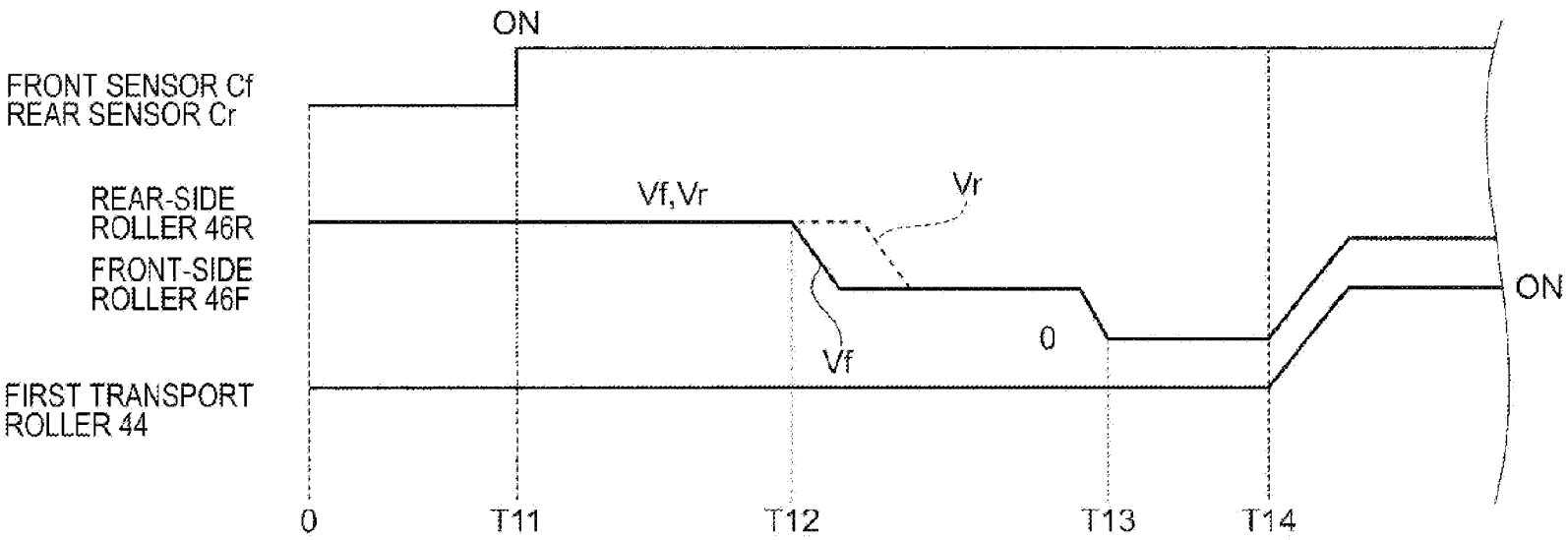
FIG. 5 is a timing chart when a thin sheet, serving as a sheet, is transported.

FIG. 5 is a timing chart when a thin sheet, serving as a sheet P, is transported.

In this embodiment, first, at time T11, the leading end of the sheet P is detected. More specifically, the leading end of the sheet P is detected by the rear sensor Cr and the front sensor Cf (see FIG. 2).

Then, at time T12, the rotation speed Vf of the front-side roller 46F is reduced to make the rotation speed Vr of the rear-side roller 46R higher than the rotation speed Vf of the front-side roller 46F, as described in step S104.

In this way, in this embodiment, the sheet P moves downstream while rotating.

More specifically, the sheet P is rotated such that the leading end thereof is directed to the front side of the image forming apparatus 100, and the sheet P moves downstream while rotating. More specifically, the sheet P is rotated such that the leading end thereof is directed to the other side SF of the first sheet transport path R1 (see FIG. 2), and the sheet P moves downstream while rotating.

In this embodiment, when the sheet P is to be rotated, the sheet-transport speed of the front-side roller 46F and the sheet transport speed of the rear-side roller 46R are differentiated. In other words, in this embodiment, the sheet P is rotated due to the difference in sheet transport speed between the front-side roller 46F and the rear-side roller 46R.

When the sheet P is rotated in this way, the sheet P is oriented in a direction at an angle to the direction in which the first sheet transport path R1 extends, and the leading end of the sheet P is positioned closer to the front side of the image forming apparatus 100 than the trailing end of the sheet P is.

While the sheet P is rotated by reducing the rotation speed of the front-side roller 46F in this embodiment, the sheet P may be rotated by increasing the rotation speed of the rear-side roller 46R.

Furthermore, the sheet P may be rotated by reducing the rotation speed of the front-side roller 46F and increasing the rotation speed of the rear-side roller 46R.

At time T13, the rotation speed Vr of the rear-side roller 46R and the rotation speed Vf of the front-side roller 46F are set to zero, and the rear-side roller 46R and the front-side roller 46F stop.

Because the sheet P has reached the second transport rollers 45 at this time, the sheet P keeps being transported downstream after the rear-side roller 46R and the front-side roller 46F stop.

Then, in this embodiment, at time T14, the first transport roller 44 starts to rotate. At time T14, the leading end of the sheet P has reached the first transport roller 44. When the first transport roller 44 starts to rotate, the sheet P is sent to the second transfer device 30 (see FIG. 1). In this embodiment, when the first transport roller 44 starts to rotate, the rear-side roller 46R and the front-side roller 46F also start (restart) to rotate.

Figure 6:
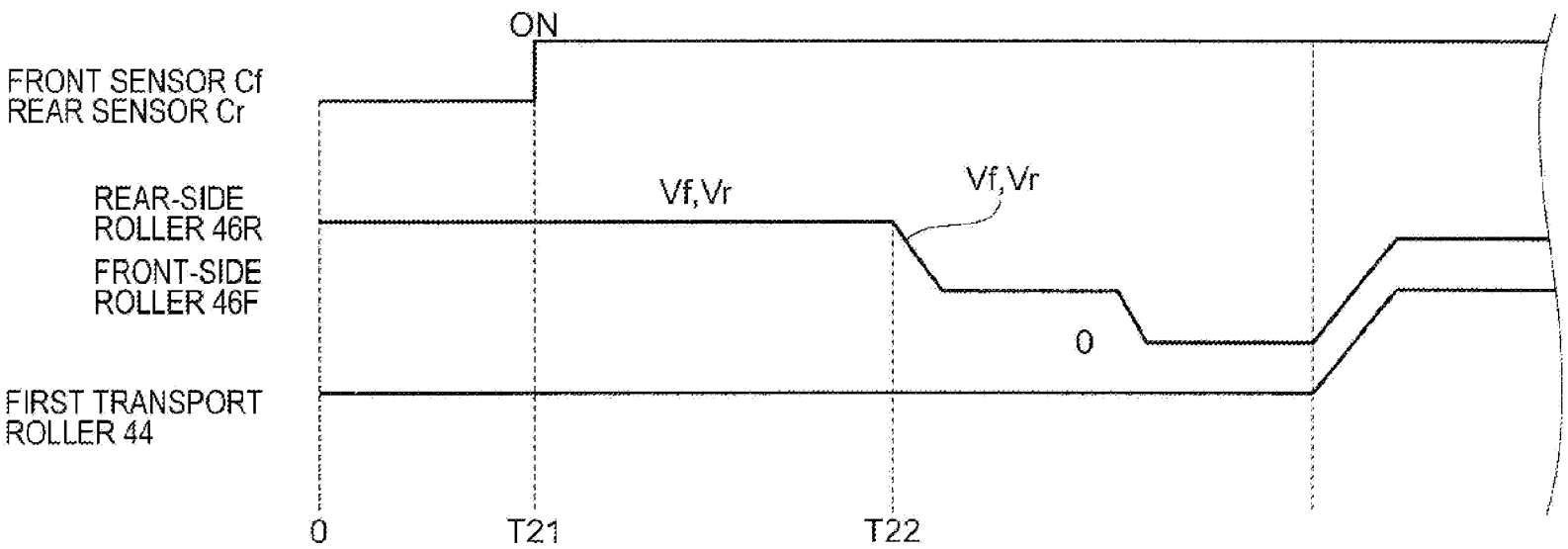
FIG. 6 is a timing chart when a thick sheet, serving as a sheet, is transported.

FIG. 6 is a timing chart when a thick sheet, serving as a sheet P, is transported.

In this case, first, at time T21, the leading end of the sheet P is detected. Then, at time T22, the rear-side roller 46R and the front-side roller 46F are reduced in rotation speed. At this time, the front-side roller 46F alone is not reduced in rotation speed; both the front-side roller 46F and the rear-side roller 46R are reduced in rotation speed.

By doing so, in the case of a thick sheet, the sheet P does not rotate (the amount of rotation of the sheet P is zero) and is transported downstream while maintaining the initial orientation.

Figure 7:
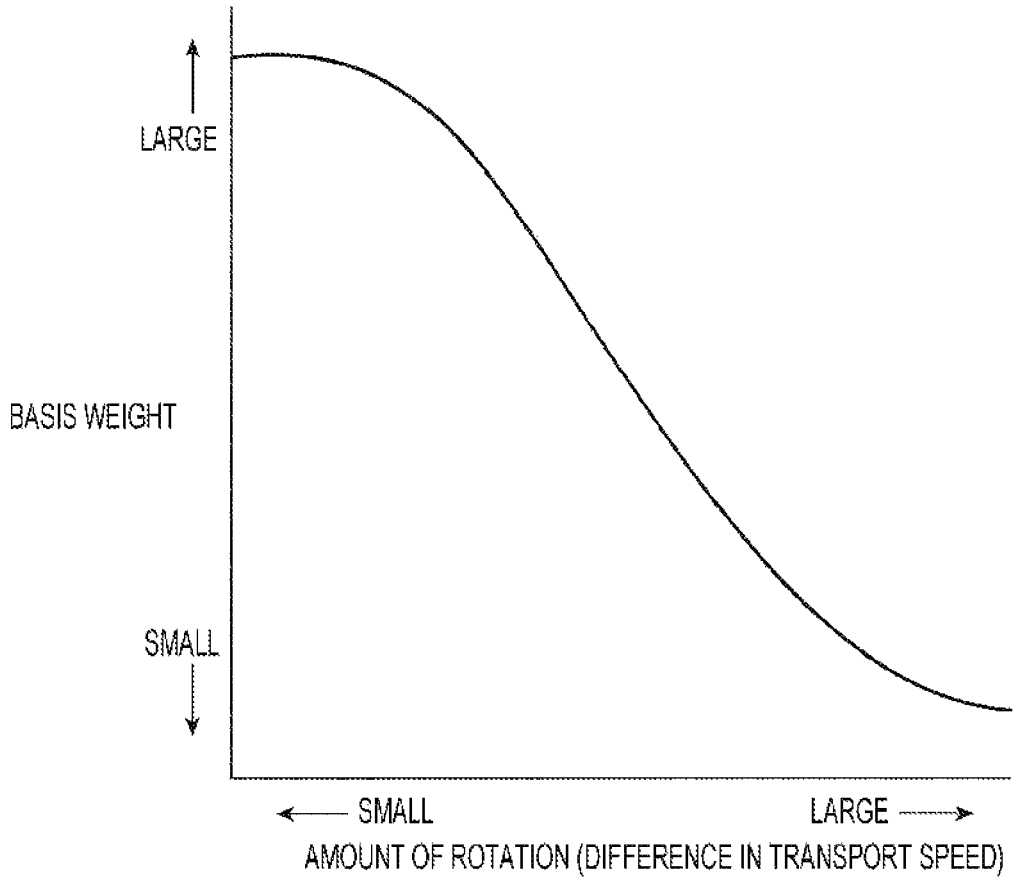
FIG. 7 is a graph showing the relationship between the basis weight and the amount of rotation (difference in transport speed)

Although the amount of rotation of the sheet P when a thick sheet is transported is set to zero in this exemplary embodiment, the amount of rotation may alternatively set to a value smaller than that when a thin sheet is transported. Furthermore, alternatively to set a single threshold (i.e., alternatively to select whether or not a sheet P is rotated), it is possible to vary the amount of rotation according to the basis weight (thickness) of the sheet P, as shown in FIG. 7 (a graph showing the relationship between the basis weight and the amount of rotation (difference in transport speed)).

Figure 8A:
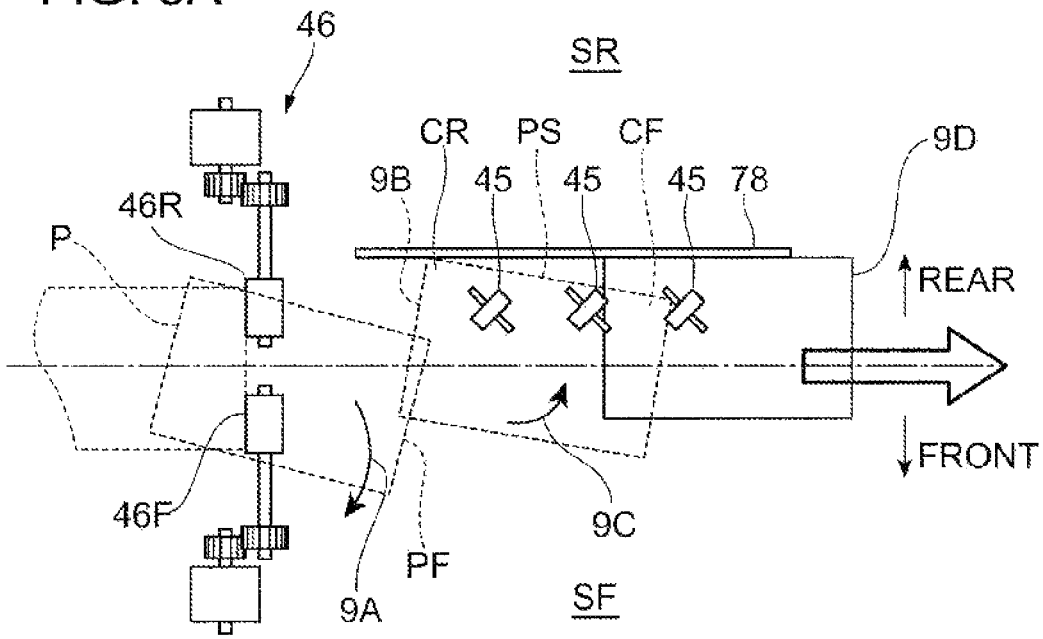
FIGS. 8A and 8B show the movement of a sheet.
Figure 8B:
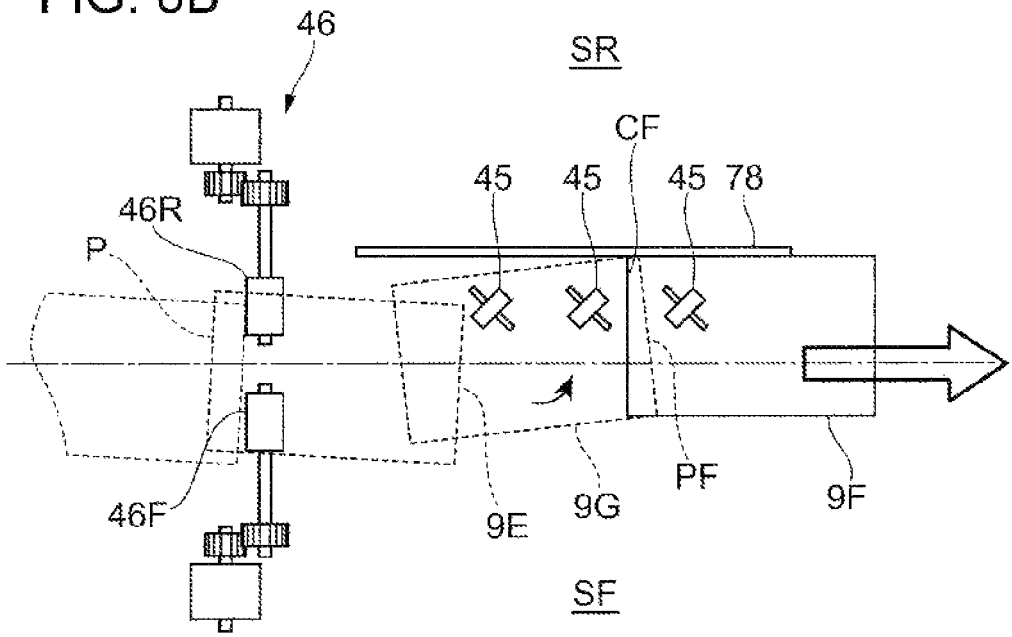

FIGS. 8A and 8B show the movement of a sheet P.

FIG. 8A shows the movement of the sheet P when a thin sheet is transported.

When the sheet P is a thin sheet, as described above, the rotation speed Vr of the rear-side roller 46R and the rotation speed Vf of the front-side roller 46F are differentiated to rotate the sheet P, as shown by arrow 9A. More specifically, the sheet P is rotated such that the leading end PF of the sheet P is directed to the front side of the image forming apparatus 100. That is, the sheet P is rotated such that the leading end PF of the sheet P is directed to the other side SF of the first sheet transport path R1.

Next, in this embodiment, the sheet P is directed to the butting portion 78 by the second transport rollers 45, and a corner CR at the trailing end on the rear side, out of four corners of the sheet P, comes into contact with the butting portion 78, as shown by reference numeral 9B.

Next, the sheet P is rotated in a direction indicated by arrow 9C about the corner CR, and the overall side edge PS of the sheet P butts against the butting portion 78.

In this way, the sheet P is oriented in a direction parallel to the sheet transport direction, as shown by reference numeral 9D.

In other words, the sheet P is oriented in one direction in which the first sheet transport path R1 extends, i.e., the sheet P is not at an angle to the one direction. Thus, in this embodiment, an inconvenience, such as an image formed on the sheet P being oblique relative to the side edge PS of the sheet P, is less likely to occur.

In this embodiment, in the case of a thin sheet, the corner CR at the trailing end of the sheet P is intentionally butted against the butting portion 78. More specifically, not a corner CF at the leading end of the sheet P (see FIG. 8A), but the corner CR at the trailing end is butted against the butting portion 78 first.

By doing so, damage to the sheet P is less likely occur, compared with a case where the corner CF at the leading end of the sheet P is butted against the butting portion 78 before the corner CR at the trailing end is.

FIG. 8B shows the movement of the sheet P when a thick sheet is transported.

When the sheet P is a thick sheet, in this embodiment, the rotation speed Vr of the rear-side roller 46R and the rotation speed Vf of the front-side roller 46F are not differentiated.

Hence, the sheet P passes through the rear-side roller 46R and the front-side roller 46F without changing its orientation, as shown by reference numeral 9E.

Then, the sheet P is directed to the butting portion 78 by the second transport rollers 45 and is butted against the butting portion 78. In this way, similarly to the above, the sheet P is oriented in a direction parallel to the sheet transport direction, as shown by reference numeral 9F.

In the case of a thick sheet, unlike a thin sheet, the sheet P is not rotated. Hence, as shown by reference numeral 9G, the corner CF at the leading end PF of the sheet P tends to butt against the butting portion 78 first. However, because the thick sheet is strong, damage to the sheet P is less likely to occur even though the corner CF at the leading end PF butts against the butting portion 78 first.

Figure 9:
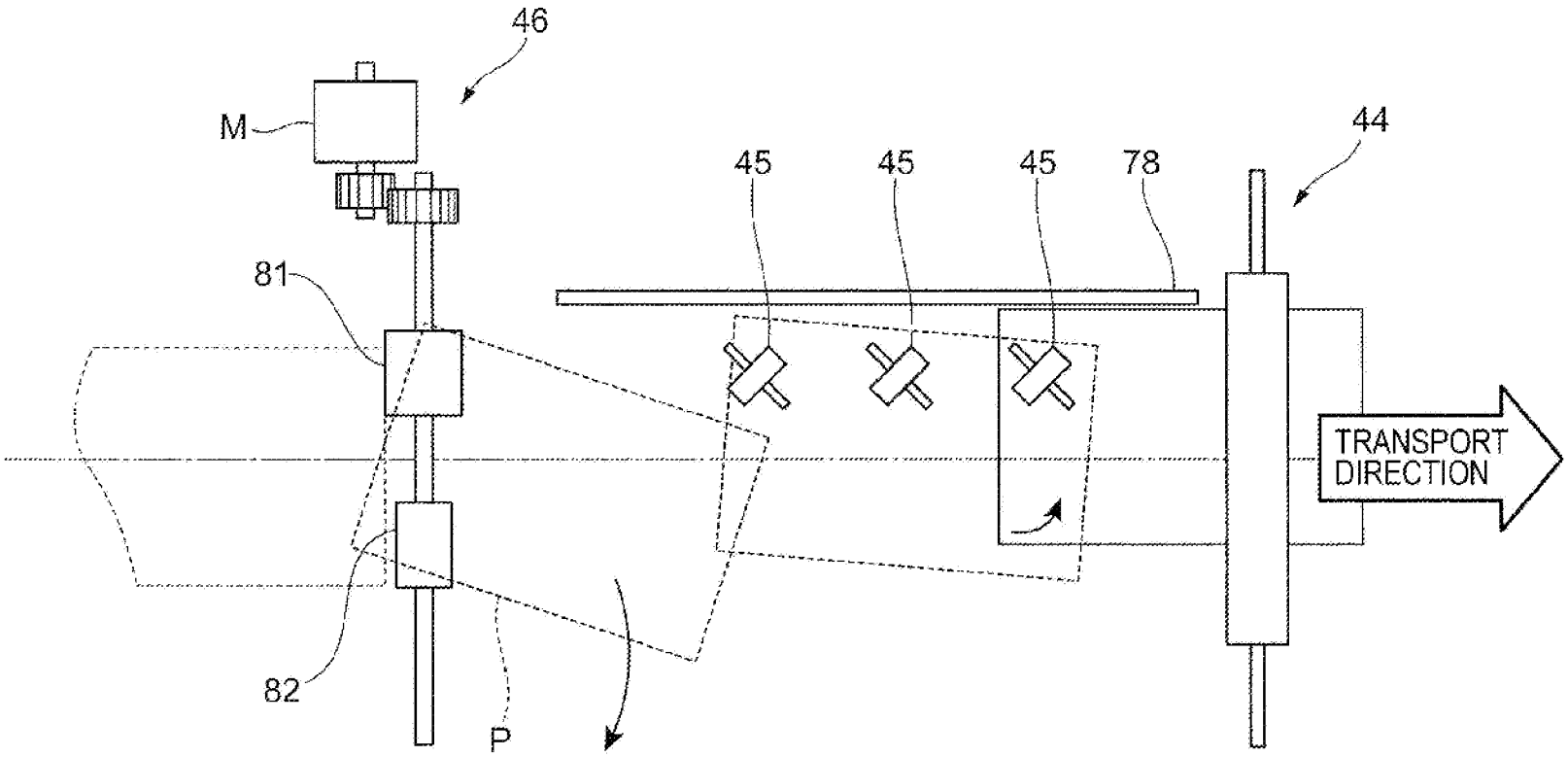
FIG. 9 shows a comparison example.

FIG. 9 shows a comparison example.

In this comparison example, two independent rotary members, such as the rear-side roller 46R and the front-side roller 46F, as employed in the above-described exemplary embodiment, are not provided. The third transport roller 46 is rotated by one motor M. Furthermore, in this comparison example, two roller members 81 and 82 that have different outside diameters are provided. A sheet P is rotated due to a difference in peripheral speed between the roller members 81 and 82.

Figure 10A:
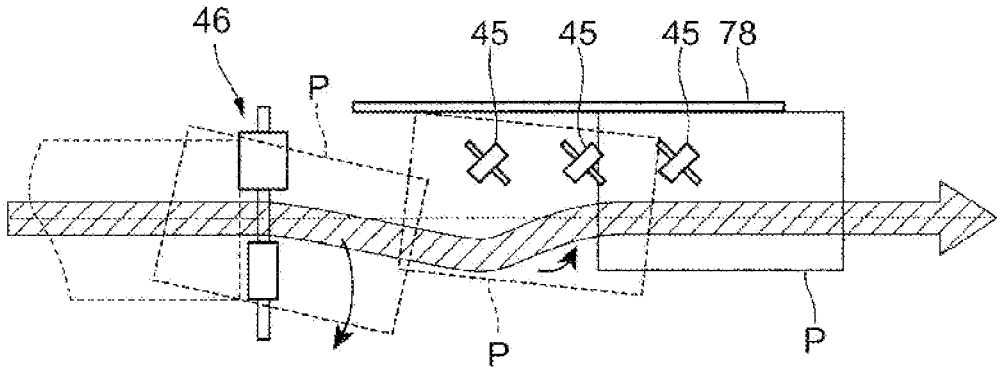
FIGS. 10A and 10B show the movement of a sheet according to the comparison example.
Figure 10B:
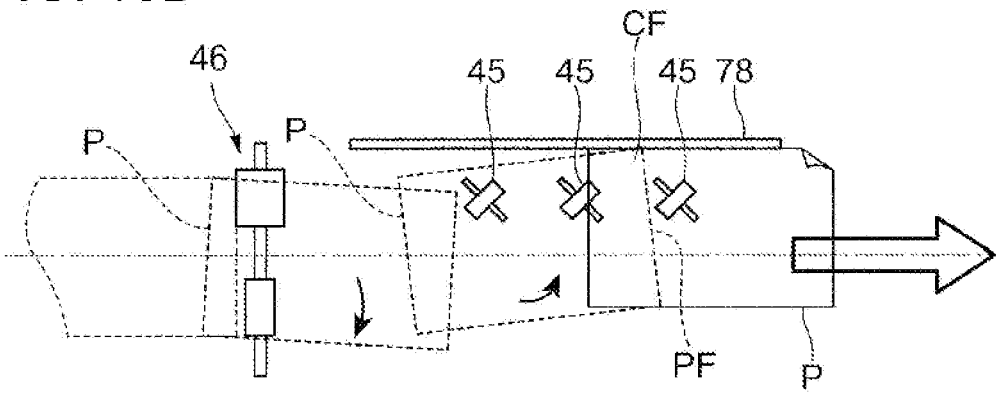

FIGS. 10A and 10B show the movement of a sheet P according to the comparison example.

As described above, when the sheet P is a thin sheet, it is desirable that the sheet P be rotated to suppress damage to the sheet P.

When the sheet P is a thick sheet, if the sheet P is rotated, the length of a path along which the sheet P travels increases, and consequently, the time for transporting the sheet P increases. In this case, the print efficiency of the image forming apparatus 100 tends to decrease. In particular, because typical transport speed for a thick sheet is usually lower than that for a thin sheet, if a sheet P that is transported at low speed is rotated, the print efficiency (transport efficiency) tends to drastically decrease.

FIG. 10A shows the movement of the sheet P when a thick is rotated.

When the sheet P is rotated, the sheet P moves first away from the butting portion 78 and then toward the butting portion 78. In this case, the distance of travel of the sheet P increases, and the transport efficiency and the print efficiency drop.

In particular, as described above, because the transport speed for a thick sheet is lower than that for a thin sheet, if the sheet P is rotated so as to move away from the butting portion 78, the efficiency of transporting the sheet P tends to drop drastically. Basically, when a thick sheet P is transported, the sheet P does not need to be rotated. However, the sheet P is rotated by a large angle in the configuration shown in FIG. 10A, and due to this rotation, the efficiency of transporting the sheet P decreases.

While such decrease in transport efficiency is suppressed by reducing the difference between the outside diameter of the roller member 81 (see FIG. 9) and the outside diameter of the roller member 82, it, in turn, increases the possibility of damage to a thin sheet P.

More specifically, by reducing the difference between the outside diameter of the roller member 81 and the outside diameter of the roller member 82, the amount of rotation of the sheet P is reduced, as shown in FIG. 10B. In this case, the corner CF of the sheet P at the leading end PF tends to butt against the butting portion 78 first, and the sheet P tends to be damaged.

To avoid such damage, the amount of rotation of the sheet P is increased. This, however, decreases the efficiency of transporting a thick sheet, as described above.

Hence, in the comparison example, it is difficult to satisfy both transporting a thin sheet without damage and transporting a thick sheet with high efficiency. In contrast, in this embodiment, as described above, because the amount of rotation of the sheet P is changed according to the basis weight of the sheet P, it is possible to satisfy both needs.

Although the amount of rotation of the sheet P is changed according to the basis weight of the sheet P in the above-described exemplary embodiment, it is also possible that information about the sheet type is obtained, and the amount of rotation is changed according to the sheet type. Furthermore, the sheet transport speed of the rear-side roller 46R and the sheet transport speed of the front-side roller 46F may be set according to the sheet type. By doing so, it is possible to suppress variation in amount of rotation of the sheet P according to the type of sheet.

For example, a normal sheet and a coated sheet, even if they have the same basis weight, have different surface conditions, and hence, they may require different amounts of rotation. In such a case, in some sheet types, regardless of the rotation control being performed, the corner CF at the leading end may come into contact with the butting portion 78, or the sheet P moves away from the butting portion 78, decreasing the transport efficiency. By controlling the rotation according to the sheet type, such an inconvenience is suppressed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

a transport path configured to transport a sheet in one direction;

a sheet butting portion configured to butt against a side edge of the sheet on the transport path, wherein the sheet butting portion is provided at one side of the transport path;

a butting section configured to move the sheet on the transport path toward the one side to butt the side edge against the sheet butting portion; and a sheet rotating section located on an upstream side of the butting section in a sheet transport direction, wherein the sheet rotating section comprises two sheet transport parts provided so as to be shifted from each other in a direction intersecting the one direction, wherein at least one of the sheet transport parts is configured to have a variable sheet transport speed, wherein the sheet rotating section is configured to rotate the sheet by utilizing a difference in transport speed between the two sheet transport parts, and wherein the sheet rotating section is configured to, in response to a basis weight of the sheet being larger than a predetermined basis weight, set an amount of rotation of the sheet to zero or to a value smaller than an amount of rotation of the sheet when the basis weight of the sheet is smaller than the predetermined basis weight.

2. A sheet transport device comprising:

a transport path configured to transport a sheet in one direction;

a sheet butting portion configured to butt against a side edge of the sheet on the transport path, wherein the sheet butting portion is provided at one side of the transport path;

a butting section configured to move the sheet on the transport path toward the one side to butt the side edge against the sheet butting portion; and a sheet rotating section located on an upstream side of the butting section in a sheet transport direction, wherein the sheet rotating section comprises two sheet transport parts provided so as to be shifted from each other in a direction intersecting the one direction, wherein at least one of the sheet transport parts is configured to have a variable sheet transport speed, wherein the sheet rotating section is configured to rotate the sheet by utilizing a difference in transport speed between the two sheet transport parts, wherein the sheet rotating section is configured to, in response to a basis weight of the sheet being larger than a predetermined basis weight, set an amount of rotation of the sheet to zero or to a value smaller than an amount of rotation of the sheet when the basis weight of the sheet is smaller than the predetermined basis weight, and wherein the sheet rotating section is configured to rotate the sheet such that a leading end of the sheet is directed to another side of the transport path.

3. A sheet transport device comprising:

a transport path configured to transport a sheet in one direction;

a sheet butting portion configured to butt against a side edge of the sheet on the transport path, wherein the sheet butting portion is provided at one side of the transport path;

a butting section configured to move the sheet on the transport path toward the one side to butt the side edge against the sheet butting portion; and a sheet rotating section located on an upstream side of the butting section in a sheet transport direction, wherein the sheet rotating section comprises two sheet transport parts provided so as to be shifted from each other in a direction intersecting the one direction, wherein at least one of the sheet transport parts is configured to have a variable sheet transport speed, wherein the sheet rotating section is configured to rotate the sheet by utilizing a difference in transport speed between the two sheet transport parts, and wherein the sheet rotating section is configured to set the sheet transport speed of each of the two sheet transport parts according to a sheet type.

* * * * *